US007717430B2

(12) United States Patent
Paramore

(10) Patent No.: US 7,717,430 B2
(45) Date of Patent: May 18, 2010

(54) GOLF GAME AND METHOD OF PLAYING

(76) Inventor: Frank Paramore, 64141 Yosemite La., Desert Hot Springs, CA (US) 92240; Dail Paramore, legal representative, 64141 Yosemite La., Desert Hot Springs, CA (US) 92240

( * ) Notice: Subject to any disclaimer, the term of this patent is extended or adjusted under 35 U.S.C. 154(b) by 91 days.

(21) Appl. No.: 12/249,858

(22) Filed: Oct. 10, 2008

(65) Prior Publication Data

US 2009/0102126 A1 Apr. 23, 2009

Related U.S. Application Data

(60) Provisional application No. 60/980,685, filed on Oct. 17, 2007.

(51) Int. Cl.
*A63F 1/00* (2006.01)

(52) U.S. Cl. ..... 273/298; 273/269

(58) Field of Classification Search ..... 273/317.2, 273/245, 259, 269, 277, 298
See application file for complete search history.

(56) References Cited

U.S. PATENT DOCUMENTS 4,021,937 A * 5/1977 Kravitz ..... 434/167
4,501,426 A * 2/1985 Seitz ..... 273/277
5,449,179 A * 9/1995 Hefferan ..... 273/269
5,458,338 A * 10/1995 Beardsley ..... 273/269
5,743,740 A * 4/1998 Visser et al. ..... 434/128
5,899,815 A * 5/1999 Helou et al. ..... 473/54
6,170,829 B1 * 1/2001 Harvey ..... 273/298
6,241,246 B1 * 6/2001 Guttin et al. ..... 273/139
6,402,145 B1 * 6/2002 Iglesias ..... 273/243
6,612,578 B2 * 9/2003 Falciglia, Sr. ..... 273/269
6,702,581 B1 * 3/2004 Walker ..... 434/167
6,722,654 B1 * 4/2004 Johnson et al. ..... 273/245

* cited by examiner

*Primary Examiner*—William M Pierce
(74) *Attorney, Agent, or Firm*—Jafari Law Group, Inc.

(57) ABSTRACT

The disclosure relates to a golf game and method of playing. More particularly, a method of gameplay which follows the career of a selected golf professional, as each game participant attempts to attain victories in the selected golf professional's career by selecting game pieces from a stack at random. A method in accordance with the disclosure entails providing a two dimensional array including the major tournament results of a selected golf professional, providing a plurality of game pieces, a player selecting a game piece, wherein the game piece corresponds to an element in the array, and repeating game piece selection for each successive player until a victory condition is met. Scoring mode, grand slam mode, and career win mode can each be used in the game play method in accordance with the present disclosure.

15 Claims, 2 Drawing Sheets

| | Masters | US Open | British Open | PGA |
|---|---|---|---|---|
| 2008 | T2 | WIN | DNP | DNP |
| 2007 | T2 | T2 | T12 | WIN |
| 2006 | T3 | CUT | WIN | WIN |
| 2005 | WIN | T2 | WIN | T4 |
| 2004 | T22 | T17 | T9 | T24 |
| 2003 | T15 | T20 | T4 | T39 |
| 2002 | WIN | WIN | T28 | T2 |
| 2001 | WIN | T12 | T25 | T29 |
| 2000 | T5 | WIN | WIN | WIN |
| 1999 | T18 | T3 | T7 | WIN |
| 1998 | T8 | T18 | T3 | T10 |
| 1997 | WIN | T19 | T24 | T29 |

| | Masters | US Open | British Open | PGA |
|---|---|---|---|---|
| 2008 | T2 | **WIN** | DNP | DNP |
| 2007 | T2 | T2 | T12 | **WIN** |
| 2006 | T3 | CUT | **WIN** | **WIN** |
| 2005 | **WIN** | T2 | **WIN** | T4 |
| 2004 | T22 | T17 | T9 | T24 |
| 2003 | T15 | T20 | T4 | T39 |
| 2002 | **WIN** | **WIN** | T28 | T2 |
| 2001 | **WIN** | T12 | T25 | T29 |
| 2000 | T5 | **WIN** | **WIN** | **WIN** |
| 1999 | T18 | T3 | T7 | **WIN** |
| 1998 | T8 | T18 | T3 | T10 |
| 1997 | **WIN** | T19 | T24 | T29 |

100 102 104 106 108 110 112 114 116

GOLF GAME AND METHOD OF PLAYING

PRIORITY NOTICE

The present application claims priority under 35 U.S.C. §119(e) to U.S. Provisional Patent Application Ser. No. 60/980,685 filed on Oct. 17, 2007, the disclosure of which is incorporated herein by reference in its entirety.

COPYRIGHT & TRADEMARK NOTICE

A portion of the disclosure of this patent application may contain material that is subject to copyright protection. The owner has no objection to the facsimile reproduction by any one of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and shall not be construed as descriptive or to limit the scope of this invention to material associated only with such marks.

TECHNICAL FIELD OF THE INVENTION

The present invention relates in general to a golf game, and more particularly, to a method of gameplay which follows the career of a selected golf professional, as each game participant attempts to attain victories in the selected golf professional's career by selecting game pieces from a stack at random.

BACKGROUND OF THE INVENTION

While all board games function as a means of entertainment, they may vary in other characteristics. Though some board games involve a complex set of rules and procedures, others involve a simple card flip or random selection. Additionally, board games may vary in theme and number of players. While some games may not appeal across the spectrum to many different audiences, there may be large demand in smaller target groups. As such, irrespective of the varying styles, functionality and characteristics, there is a demand for board games.

In recent years, electronic games have seen a huge rise in popularity. While board games retain their appeal and will most certainly remain popular in the future, their electronic counterparts open up games to a wider audience. Additionally, electronic embodiments of popular games are desirable because they allow for gameplay when utilizing the physical game may not be appropriate (for example, playing the card game solitaire while at work). Therefore, there is a demand for games that can be offered in a plurality of mediums, whether they are physical or electronic.

Golf is a sport that has been played and celebrated around the world for centuries. With the advent of international broadcasts and advertising, golf's popularity continues to increase. Consequently, there has been a surge in demand for golf merchandise and other products. As such, it is desirable to utilize golf statistics and other golf qualities within board and electronic games because golf enthusiasts demand it.

There is a need in the art for a golf game which will combine competitive game aspects and entertainment with the career history of a selected golf professional to simulate the victories in professional golf major tournaments. It is to these ends that the present invention has been developed.

SUMMARY OF THE INVENTION

To minimize the limitations in the prior art, and to minimize other limitations that will be apparent upon reading and understanding the present specification, the present invention relates to a method for playing a golf game designed to simulate a selected golf professional's career by selecting random game pieces from a stack.

The game board comprises of an array wherein the rows represent the years of professional golfer's career, and the columns represent the four majors of the golf season. The game also includes a plurality of game pieces equal to the number of elements in the array. Each game piece has a label corresponding to one element on the array, thereby representing a select golf professional's results at the major tournament of the selected year. During game play, players take turns selecting a game piece, thereby awarding them the corresponding results in the array. Gameplay ends when a player has satisfied a pre-game selected victory condition.

It is an objective of the present invention to create interest in the game of golf.

It is another objective of the present invention to provide entertainment.

It is yet another objective of the present invention to educate game players about professional golf tournament results.

Finally, it is yet another objective of the present invention to simulate a select golf professional's tournament career.

These and other advantages and features of the present invention are described herein with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

FIG. 1(*b*) illustrates a flow chart depicting the present invention wherein the game method is demonstrated.

DETAILED DESCRIPTION OF THE DRAWINGS

In the following discussion that addresses a number of embodiments and applications of the present invention, reference is made to the accompanying drawings that form a part hereof, where depictions are made, by way of illustration, of specific embodiments in which the invention may be practiced. It is to be understood that other embodiments may be utilized and changes may be made without departing from the scope of the present invention.

Figure 1A:
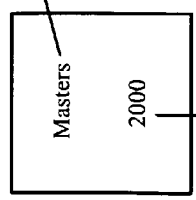
FIG. 1(*a*) illustrates exemplary embodiments of the game system provided by the present invention, including an array and a plurality of game pieces.
Figure 1B:
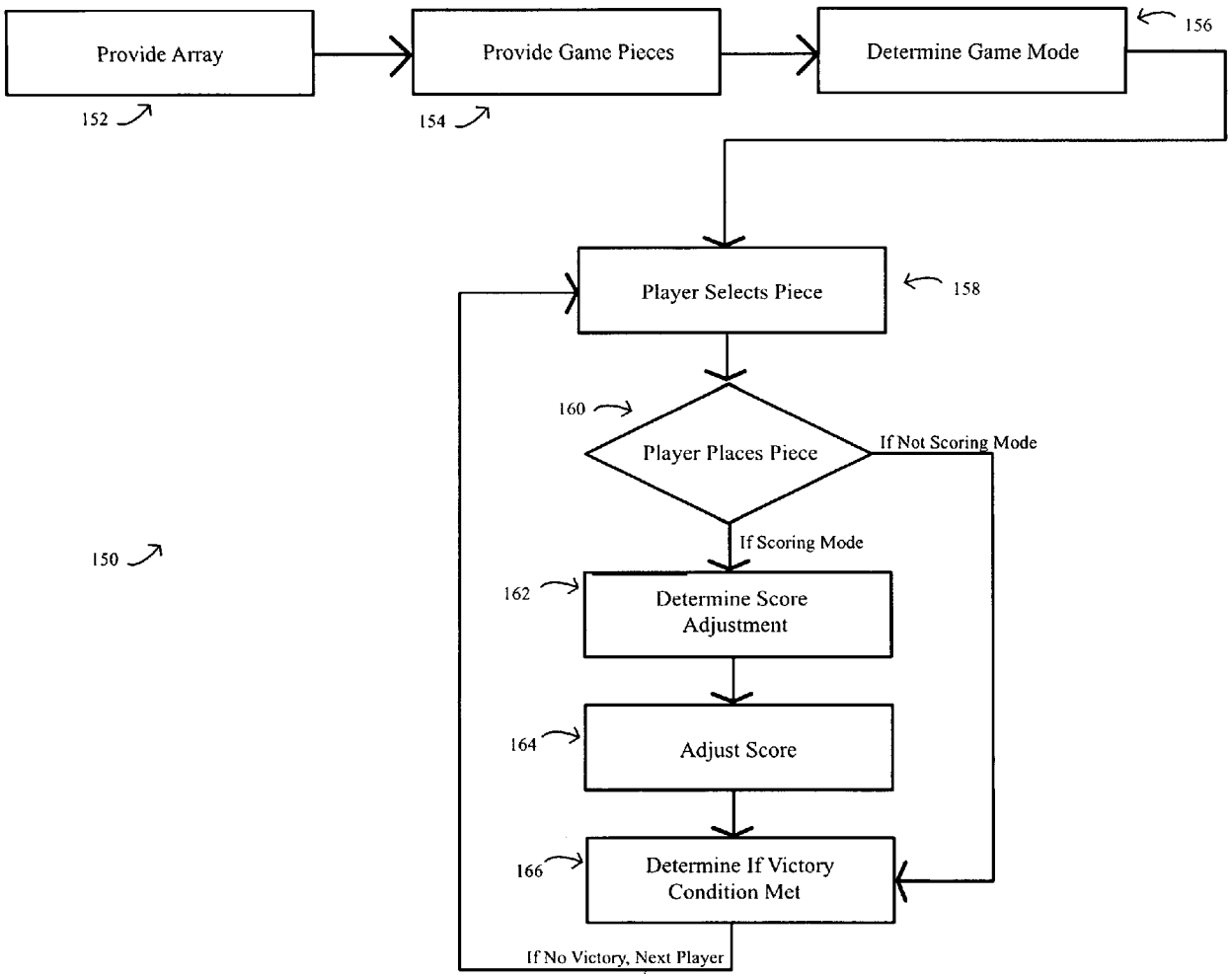

Turning to the first figure, FIG. 1(*a*) illustrates an exemplary embodiment of the game system provided by the present invention, including a two-dimensional array and a plurality of game pieces. FIG. 1(*a*) shows game system 100, which includes a two-dimensional array 102, rows 104, columns 106, elements 108, tournament result 110, game piece 112, and game piece labels 114 and 116. Game system 100 is designed to be utilized in the method of gameplay described in the present invention.

Broadly viewed, game system 100 contains array 102 and a plurality of game pieces 112. Array 102 represents the major tournament results of a select golf professional. In accordance with the particular game system 100 illustrated in FIG. 1(*a*), array 102 may represent the career tournament results of Tiger Woods. However, array 102 may also represent the career tournament results of any select golf professional. For example, without limiting the scope of the present invention, array 102 may include the career tournament results of Jack Nicklaus, Arnold Palmer, or any other current or former golf professional that participated in a major golf tournament on the professional circuit.

In one embodiment, array 102 may be presented upon a game board and be created from a variety of materials. These materials include cardboard, wood, metal, fiberglass or any other rigid type material which can sustain the wear and tear of frequent use. For example, in one embodiment, game system 100 may be physically embodied with array 102 printed upon a foldable cardboard game board. It should be noted, however, that the list of materials aforementioned is in no way exhaustive and should not be used to limit the scope of the present invention.

In another embodiment, game system 100 may be digitally represented, with array 102 and game pieces 112 virtually generated. Each element of gameplay may be embodied digitally, allowing for user interaction and control through graphical representation of the array and game pieces on a screen. For example, in an embodied designed for the personal computer, a graphical representation of the game system 100 may be displayed on the monitor, wherein user selects game pieces 112 and interacts with array 102 through a mouse, keyboard or any known game control device.

Each game piece 112 may be randomly generated on the screen at each player's turn. When the game piece 112 is randomly generated, it flashes intermittently on random elements of the array 102. The random positioning of the game piece 112 allows the player the option of selecting a "WIN" should the game piece 112 intermittently flash over an element of the array 102 containing a "WIN." Each player's turn may be timed, in increments such as 15, 20 or 30 seconds, for the purpose of testing the player's hand-eye coordination as well as reaction time. Furthermore, in alternative embodiments, array 102 may comprise of three dimensional objects and need not be limited to the two dimensional or digital embodiments described.

In array 102, each individual row 104 may represent a year of a selected golf professional's career. For example, if the selected golf professional competed in major tournaments in 2005, the row containing tournament results from that year would be labeled 2005. Each individual column 106 may represent a major golf tournament on the professional golf circuit. The four columns may be labeled "Master's," "PGA Championship," "British Open," and "U.S. Open."

Array 102 contains a plurality of elements 108. The number of elements 108 contained in array 102 equals the product of the number of rows 104 multiplied by the number of columns 106. For example, should array 102 contain six rows and four columns, then array 102 would contain twenty-four elements.

Element 108 may be identified by the labels of row 104's particular year and column 106's major golf tournament. Each element 108 contains a unique tournament result 110 for a selected golf professional in a single major golf tournament in a given year. Tournament result 110 represents the tournament result of a selected golf professional in element 108's row 104 and column 106.

The number of game pieces 112 is equal to the number of elements 108 in array 102. While the embodiment shown in FIG. 1(*a*) illustrates game piece 112 as a square shaped chip, this in no way should limit the scope of the invention. The game pieces provided can be shaped or embodied by any number of physical or digital means.

Game pieces 112 may be composed from a variety of materials. For example, in one embodiment, game pieces 112 may be composed of small, wooden chips. In another embodiment, game pieces 112 may be either composed of cardboard, metal, fiberglass, or even digitally represented. It should be noted, however, that the aforementioned examples should not be interpreted so as to limit the scope of the present invention.

The face of every game piece 112 may include game piece labels 114 and 116. Game piece labels 114 and 116 identify a specific element 108 in array 102. Game piece label 114 corresponds to a specific row 104, meaning that game piece label 114 will identify a year of a selected golf professional's career. Game piece label 116 corresponds to a specific column 106, meaning that game piece label 116 will identify a major golf tournament on the professional golf circuit. Thus, game piece 112 will correspond to a particular element 108, thus identifying tournament result 110 through game piece labels 114 and 116.

Should a selected golf professional complete another year, or part thereof, on the professional golf circuit, game system 100 may be modified to stay up to date. Consequently, additional rows 104 may be added to array 102 for each new year played by a selected golf professional. Accordingly, new tournament results 110 may be added to array 102 corresponding to new elements 108 in new row 104. New game pieces 112 may be added to game system 100 to correspond to the new elements 108.

FIG. 1(*b*) illustrates a flow chart of method 150 depicting the present invention wherein the game method is demonstrated. Method 150 is explained in the order shown below; however, the following steps may be taken in any other conceivable sequence without deviating from the scope of the present invention. Further, additional steps may be taken during gameplay without deviating from the scope of the present invention.

At step 152, depending upon the game mode selected, to be discussed below, the array 102 (see FIG. 1(*a*)) may be provided for each player, or for the group of players as a whole. For example, should the players decide to each use their own game board, array 102 may be provided to each player. However, if the players decide to only use one game board, array 102 may be provided to the group as a whole.

The statistics in array 102 provided represent the tournament results for a selected golf professional. For example, in one embodiment, array 102 is printed upon a game board and follows the career of a selected golf professional, such as Tiger Woods. For every year of Tiger Wood's career, his tournament results of the four major golf tournaments are printed on the game board in the array. Thus, for example, because Tiger Woods won the 1997 Master's, tournament result 110 in element 108 (see FIG. 1(*a*)) under the 1997 Master's championship is labeled "WIN." However, the tournament result 110 in the element 108 under the 2002 British Open is labeled "T28," because Tiger Woods tied for $28^{th}$ place in the 2002 British Open.

At step 154, depending upon the game mode selected, a plurality of game pieces 112 (see FIG. 1(*a*)) may be provided for each individual player, or for the group of players as a whole. Should the players decide to each use their own game board, a plurality of game pieces 112 may be provided to each player. However, if the players decide to only use one game board, a plurality of sets of game pieces 112 may be provided to the group as a whole.

If using one game board, each player will receive a set of game pieces 112, each set having a particular color, such as red, blue, green and yellow. Thus, when each player takes his or her turn, all of the other players will be able to distinguish each of the other player's game pieces 112 on the array 102.

The number of game pieces 112 corresponds to the number of elements 108 in array 102. Each game piece 112 individually corresponds to a particular tournament result 110 by matching game piece labels 114 and 116 to row 104 and column 106 in array 102. For example, a game piece labeled 2002 U.S. Open would correspond to the element in array 102 in the row labeled 2002 and column labeled U.S. Open.

At step 156, the game mode is determined. There are three different game modes. Each game mode has a different victory condition. The three game modes are scoring mode, grand slam mode, and career win mode. Note that the three game modes and victory conditions described do not comprise of an exhaustive list and in no way should limit the scope of the present invention.

In scoring mode, each player's score is tallied throughout gameplay by first designating one of the players as a scorekeeper. At the outset of gameplay, each player begins with a score of zero. Each player's score is adjusted throughout gameplay. After a player's turn, depending upon the game piece 112 selected, the player's score may be adjusted. Gameplay is concluded when a player has accumulated every tournament victory in the selected golf professional's career. At the conclusion of gameplay, the player with the lowest cumulative score is declared winner.

In grand slam mode, there are two types of gameplay that may be employed in order to result as the winning player. First, the first player to accumulate at least one element 108 containing a tournament result 110 of "WIN" in all four columns of array 102 is declared winner. Thus, in grand slam mode, gameplay is concluded when a player accumulates at least one victory in the Masters, the U.S. Open, the British Open, and the PGA Championship. Similarly, grand slam mode may be played by accumulating at least one element 108 containing a tournament result 110 of "WIN" in each of the rows of array 102 in order to win.

In career win mode, the first player to accumulate all elements 108 in array 102 with tournament results 110 of "WIN" is declared winner. Thus, the first player to accumulate every win in a selected golf professional's career is the winner. Alternatively, the player to accumulate the most elements 108 in array 102 with tournament results 110 of "WIN" is declared winner. In this embodiment, the player with the most wins in a selected golf professional's career is the winner.

After a game mode is selected, gameplay begins at step 158. In step 158, a player selects a game piece 112. Game piece 112 should be selected at random from the plurality of game pieces provided in step 154.

At step 160, game piece 112 is placed on array 102 at element 108 corresponding to the row 104 and column 106 identified by game piece labels 114 and 116. For example, should game piece 112 selected be labeled the 2000 Masters, game piece 112 is placed in array 102 at element 108 corresponding to the 2000 Masters. If the game is being played in scoring mode, play proceeds to step 162. If, however, the game is being played in grand slam or career win mode, gameplay proceeds to step 166.

At step 162, if the game is being played in scoring mode, the adjustment to a player's score is determined. Depending upon the corresponding tournament result 110 to the selected game piece 112, the player's score may remain the same, be reduced by one point, or increased by one point. When the game piece 112 selected corresponds to element 108 containing a winning tournament result 110, the player's score should be reduced by one point. For example, if the selected game piece 112 was labeled 2004 British Open, and the selected golf professional, whose career tournament results are portrayed by array 102, won the 2004 British Open, the player's scoring should be reduced by one.

When the game piece 112 selected corresponds to an element 108 containing non-winning tournament result 110, and the row 104 containing element 108, identified by the selected game piece label 114, does not contain a single major tournament win by the selected golf professional, the player's score should be increased by one point. For example, a player's score should be increased by one point when the selected game piece 112 corresponds to the 1999 U.S. Open, but the selected golf professional, whose career tournament results are portrayed by array 102, did not win any major golf tournaments in 1999.

Finally, when the game piece 112 selected corresponds to an element 108 containing non-winning tournament result 110, but the row 104 containing element 108, identified by the selected game piece label 114, contains major tournament win by the selected golf professional, the player's score should remain the same. For example, a player's score should remain the same and not be adjusted when the selected game piece 112 corresponds to the 2002 PGA Championship and the selected golf professional, whose career tournament results are portrayed by array 102, did not win the 2002 PGA Championship, but the selected golf professional won the 2002 Masters.

After the score adjustment is determined, the player's score should be adjusted at step 164. Step 164 should only be performed if the game is played in scoring mode. In step 164, the score adjustment determined in step 162 is applied to the player's score. For example, should a player have a score of 3 points, and the score adjustment determined in step 162 was to subtract 1 from the player's score, the player would have a new adjusted score of 2 points. Once the player's score has been adjusted, the player's turn is over.

At step 166, it is determined whether a victory condition has been met. Step 166 is performed in all game three modes. If a victory condition has been met, game play is over and a winner is declared. If, however, a victory condition has not been met, play proceeds back to step 158.

In scoring mode, a victory condition is met if all winning tournament results have been accumulated by a player. When a player has accumulated all winning tournament results, the player with the lowest score is declared winner.

In grand slam mode, the victory condition is met if the player has accumulated at least one win in all four major tournaments. A player is declared winner in grand slam mode if they accumulate at least one win in all four columns of array 102.

In career win mode, the victory condition is met if a player has accumulated every victory in a selected golf professional's career. A player is declared winner in career win mode if they accumulate every winning tournament result in array 102.

If a victory condition has not been met, the player's turn is over. Once a player's turn has ended, and no victory conditions have been met, it is the next player's turn, returning to step 158. Play rotates in a clockwise fashion, but this in no way limits the scope of the present invention. Players may choose their own method of determining order of turns.

Should a victory condition be met, the winner is declared based upon the victory conditions of the selected game mode.

A golf game and method of playing has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching. It is intended that the scope of the invention not be limited by this detailed description, but by the claims and the equivalents to the claims.

What is claimed is:

1. A method of playing a game to be played by a plurality of players, comprising the steps of:

(a) for each player, providing a two dimensional array representing annual major tournament results of a selected golf professional, wherein said array comprises a plurality of rows, each of which is labeled for each year of the professional on the tour, and a set of columns, each of which is labeled with each of the golf professional's major tournaments;

(b) for each player, providing a set number of game pieces equal to a total number of elements in the array, whereby each game piece corresponds to a particular element in the array;

(c) randomly selecting a piece by each player, wherein the player is awarded the designated element in the array; and (d) repeating step (c) for each successive player until play is concluded.

2. The method of claim 1, further providing that each element in the array contains the selected golf professional's tournament result for the given year.

3. The method of claim 1, further providing that play is concluded when one of the player has been awarded the elements in the array corresponding to each of the columns wherein the selected golf professional placed first.

4. The method of claim 1, further providing that play is concluded when one of the players has been awarded the elements in the array corresponding to each of the rows wherein the selected golf professional placed first.

5. The method of claim 1, further providing that play is concluded when one of the players has been awarded all elements in the array wherein the selected golf professional placed first.

6. The method of claim 1, further providing that play is concluded through a determination of score points.

7. The method of claim 6, in which one player is a designated scorekeeper.

8. The method of claim 6, further comprising the step of tracking and adjusting a player's score after selecting one of the elements by:

subtracting one point should the piece correspond to a tournament victory of the selected golf professional;

adding one point should the piece correspond to a tournament in which the selected golf professional did not win a single major in that given year; or making no adjustment to the players score, should the piece correspond to a tournament loss, but the professional won a tournament in that given year.

9. The method of claim 8, wherein players begin the game with a score of zero.

10. The method of claim 1, further providing that additional rows may be added to the playing array along with corresponding pieces, due to a new golf season results from the selected golf professional.

11. The method of claim 1, wherein the array is physically embodied by a game board composed on a flat surface, having an array displaying the major career tournament results of the selected golf professional.

12. The method of claim 1, wherein the array is embodied in a digital graphical representation.

13. The method of claim 12, wherein a player is provided with a randomly selected digital graphical representation of the game piece.

14. The method of claim 13, wherein the player chooses a randomly selected digital graphical representation of said game piece.

15. The method of claim 14, wherein the player has a finite amount of time in which to choose a randomly selected digital representation of said game piece.

* * * * *